United States Patent [19]

Mountain et al.

[11] Patent Number: 4,463,978

[45] Date of Patent: Aug. 7, 1984

[54] DIVING TANK HANDLE

[76] Inventors: Craig S. Mountain; Thomas D. Drunasky, both of P.O. Box 1083, Palm Harbor, Fla. 33563

[21] Appl. No.: 436,859

[22] Filed: Oct. 15, 1982

[51] Int. Cl.[3] ..... B65D 63/18

[52] U.S. Cl. ..... 294/31.2; 294/15; 294/165

[58] Field of Search ..... 294/31.2, 15, 165, 137, 294/146, 141, 142, 143, 166, 167, 168, 169; 16/114 R; 215/100 A; 248/26, 39, 83, 89, 313, 316 D

[56] References Cited

U.S. PATENT DOCUMENTS 3,817,435 6/1974 De Luca ..... 294/31.2

4,345,789 8/1982 Garnett ..... 294/31.2

*Primary Examiner*—James B. Marbert

*Attorney, Agent, or Firm*—Stanley M. Miller

[57] ABSTRACT

A diving tank handle is disclosed, for selective attachment to a cylindrical diving tank. The apparatus includes a clamping ring for slideably engaging the peripheral surface of the diving tank in an unclamped state and for frictionally engaging the peripheral surface of the diving tank in a clamped state, the clamping ring having an open side with a pair of opposed end surfaces. The apparatus further includes a cam pivotally mounted to the clamping ring between the opposed end surfaces, on a pivot axis perpendicular to the cylindrical axis of the diving tank. The apparatus further includes a handle portion mounted to the cam for clamping the ring to the diving tank by rotating the cam. The diving tank handle may be easily slipped onto the diving tank with the handle portion in the clearance position, compactly stored while mounted on the diving tank with the handle portion in the storage position and the diving tank conveniently carried with the handle portion in the lifting position.

10 Claims, 5 Drawing Figures

Lifting Position

Storage Position

SEC. 2-2'

Clearance Position

DIVING TANK HANDLE

FIELD OF THE INVENTION

The invention disclosed broadly relates to sporting equipment and more particularly relates to accessories for diving equipment.

BACKGROUND OF THE INVENTION

Self-contained underwater breathing apparatus usually consists of a diving tank filled with compressed air or oxygen, which is strapped to the back of the diver so that the diver is independent of an external supply of air and is free to move about underwater without being impeded by hoselines. Although the diving tank is buoyant and essentially weightless underwater, it is quite heavy above water, often weighing over sixty pounds. As such, the diving tank is cumbersum to handle, carry and store.

OBJECTS OF THE INVENTION

It is therefor an object of the invention to make diving tanks easier to handle, carry and store.

SUMMARY OF THE INVENTION

This and other objects, features and advantages of the invention are accomplished by the diving tank handle disclosed herein. A diving tank handle is disclosed, for selective attachment to a cylindrical diving tank. The apparatus includes a clamping ring for slideably engaging the peripheral surface of the diving tank in an unclamped state and for frictionally engaging the peripheral surface of the diving tank in a clamped state, the clamping ring having an open side with a pair of opposed end surfaces. The apparatus further includes a cam pivotally mounted to the clamping ring between the opposed end surfaces, on a pivot axis perpendicular to the cylindrical axis of the diving tank. The apparatus further includes a handle portion mounted to the cam for clamping the ring to the diving tank by rotating the cam. The diving tank handle may be easily slipped onto the diving tank with the handle portion in the clearance position, compactly stored while mounted on the diving tank with the handle portion in the storage position and the diving tank conveniently carried with the handle portion in the lifting position.

DISCUSSION OF THE PREFERRED EMBODIMENT

A diving tank handle is disclosed, for selective attachment to a cylindrical diving tank. The apparatus includes a clamping ring for slideably engaging the peripheral surface of the diving tank in an unclamped state and for frictionally engaging the peripheral surface of the diving tank in a clamped state, the clamping ring having an open side with a pair of opposed end surfaces. The apparatus further includes a cam pivotally mounted to the clamping ring between the opposed end surfaces, on a pivot axis perpendicular to the cylindrical axis of the diving tank. The apparatus further includes a handle portion mounted to the cam for clamping the ring to the diving tank by rotating the cam. The diving tank handle may be easily slipped onto the diving tank with the handle portion in the clearance position, compactly stored while mounted on the diving tank with the handle portion in the storage position and the diving tank conveniently carried with the handle portion in the lifting position.

Figure 1:
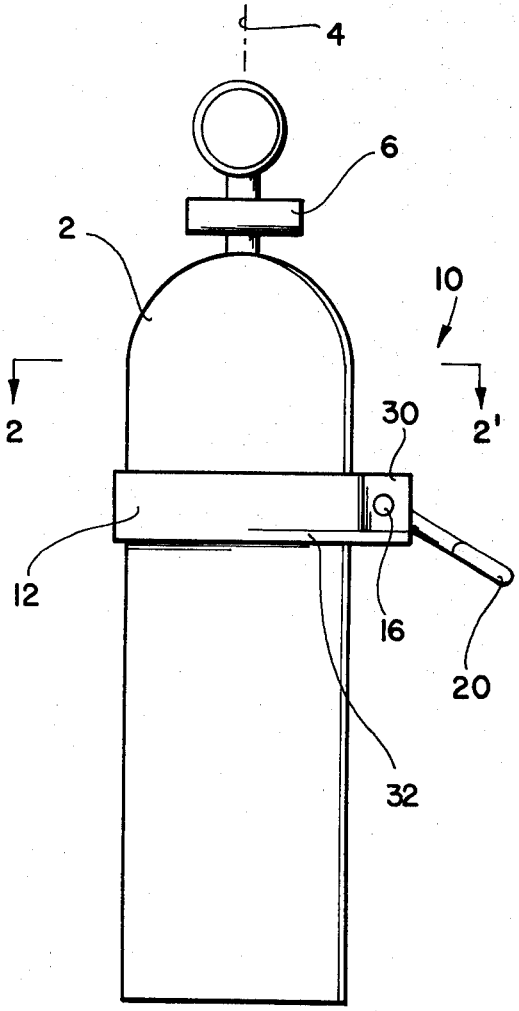
FIG. 1 is an overall view of the diving tank handle invention as it appears when installed on a cylindrical diving tank.

FIG. 1 shows the diving tank handle 10 for selective attachment to a cylindrical diving tank 2. The tank 2 has a compressed air valve 6 for controlling the amount of air delivered by the tank. FIGS. 2 through 5 show more detailed views of the diving tank handle invention 10.

Figure 3:
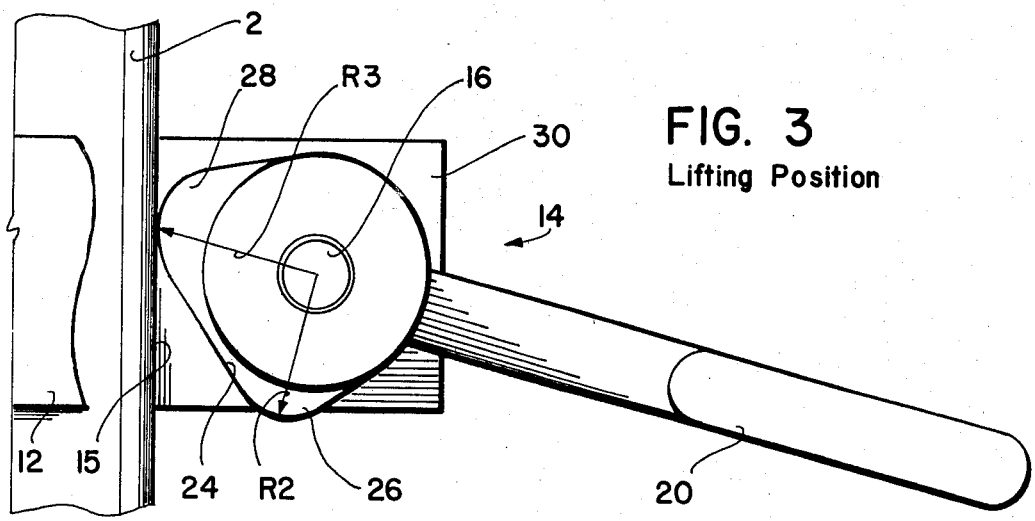
FIG. 3 is a side view of the diving tank handle invention with the handle portion in the lifting position.
Figure 5:
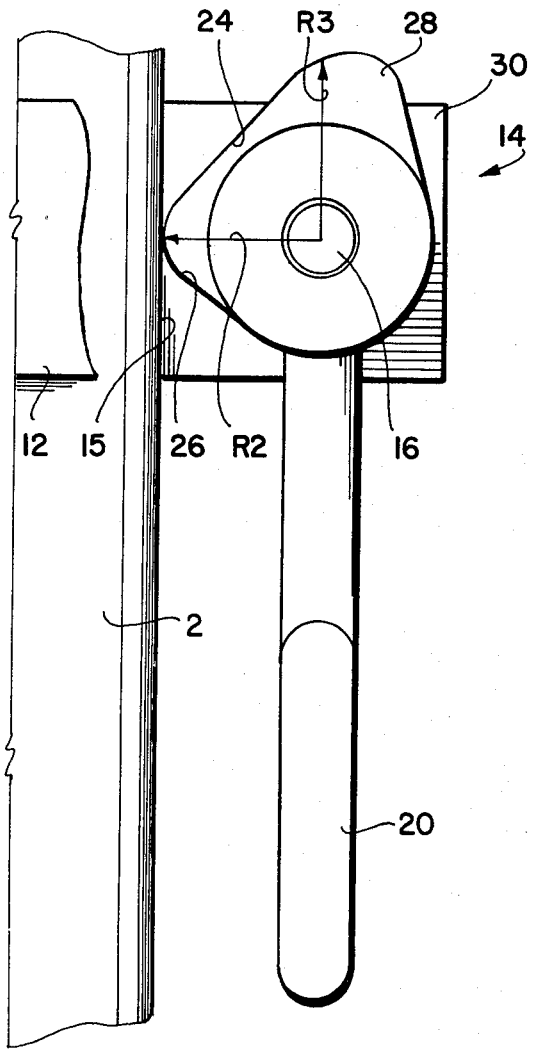
FIG. 5 is a side view of the diving tank handle invention with the handle portion in the storage position.
Figure 2:
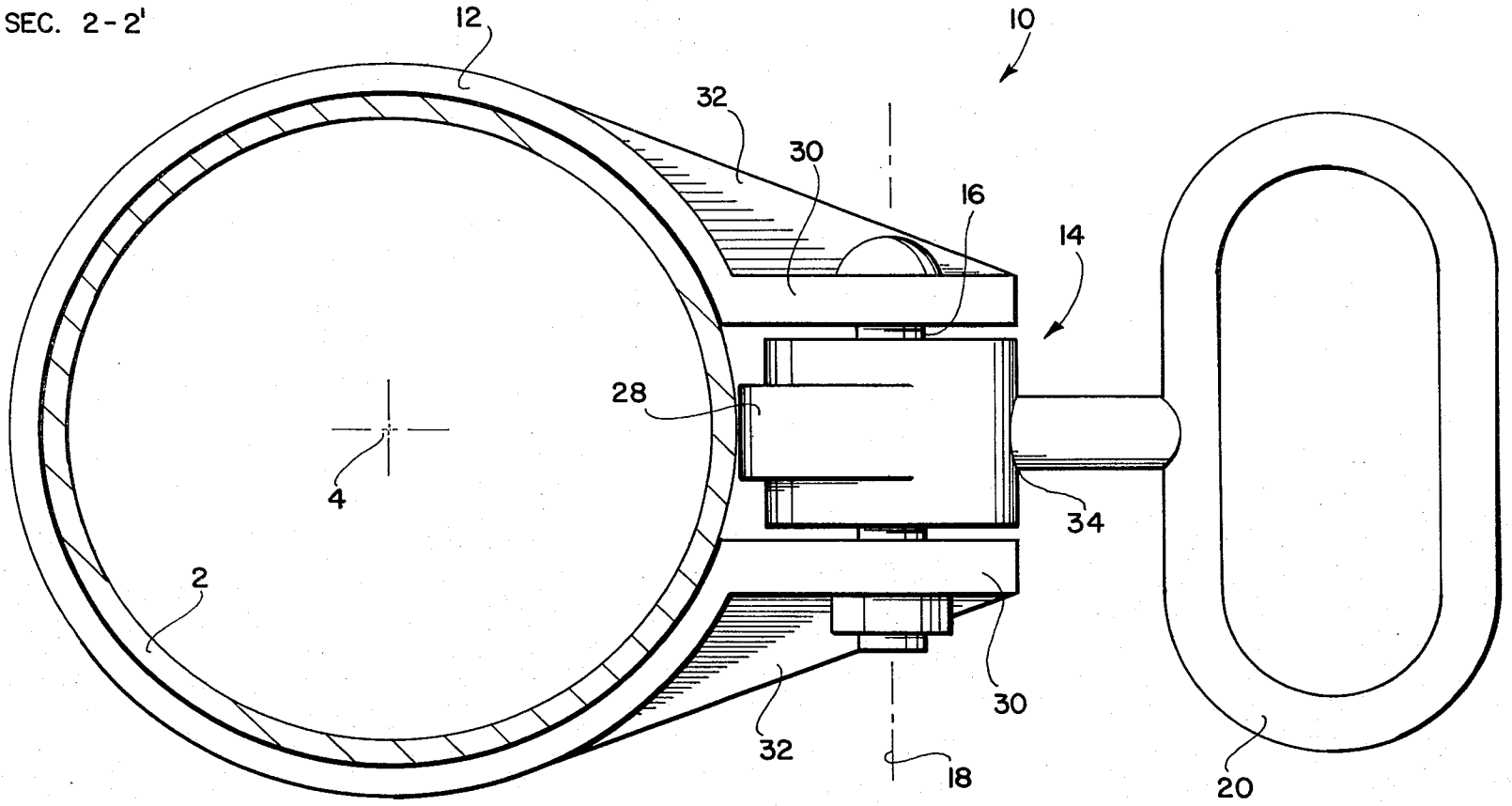
FIG. 2 is a top cross sectional view along the section line 2—2′ of FIG. 1, of the diving tank handle invention.
Figure 4:
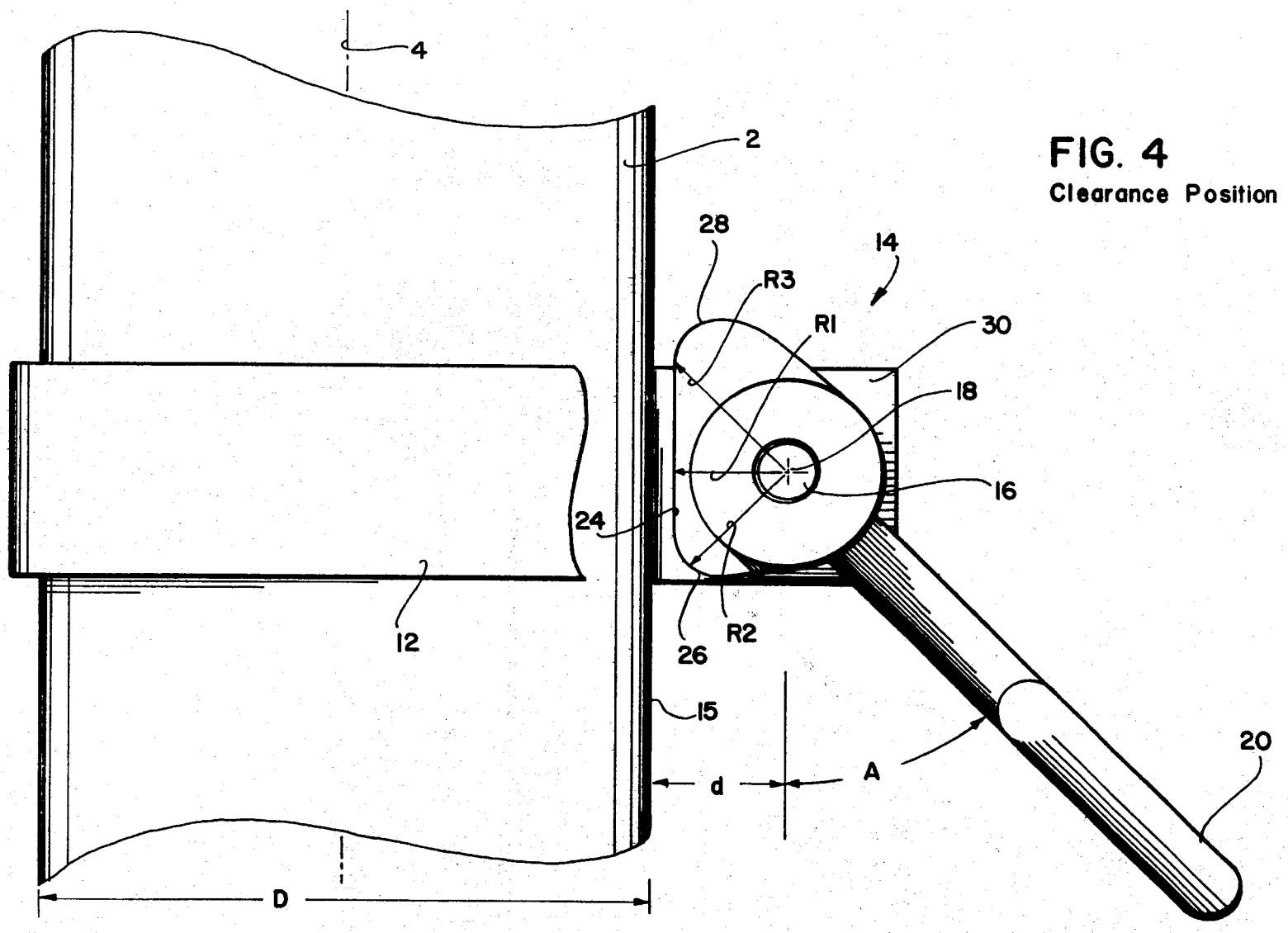
FIG. 4 is a side view of the diving tank handle invention with the handle portion in the clearance position.

FIG. 2 shows a clamping ring 12 having a substantially circular cross section with an inner diameter of slightly greater dimension than the outer diameter D (which can be 8 inches, for example) of the diving tank 2, for slideably engaging the peripheral surface 15 of the diving tank 2 in an unclamped state as is shown in FIG. 4 and for frictionally engaging the peripheral surface 15 of the diving tank 2 in a clamped state as is shown in FIGS. 3 and 5. The clamping ring 12 has an open side with a pair of opposed end mounting surfaces 30 as shown in FIG. 2. A reinforcing rib 32 can stiffen the structure of the ring 12 and make it clamp the tank 2 more effectively.

FIG. 2 shows a cam 14 pivotally mounted by means of the shaft 16 to the clamping ring 12 between the opposed end surfaces 30, on a pivot axis 18 perpendicular to the cylindrical 4 axis of the diving tank 2. The pivot axis 18 is located at a pivot distance d (of 1.0 inches, for example) from the peripheral surface 15 of the diving tank 2 within the clamping ring 12. The cam 14 has a first lobe 26 with an actuating surface at a radial distance R2 (of 1.050 inches, for example) from the pivot axis 18 which is slightly greater than the pivot distance d, the first lobe 26 being located on the first radius vector R2 from the pivot axis 18. The cam 14 has a clearance surface 24 at a radial distance R1 (of 0.8 inches, for example) from the pivot axis 18 which is slightly less than the pivot distance d, the clearance surface 24 being located on the second radius vector R1 from the pivot axis 18, the second radius vector R1 being angularly displaced by a clearance angle A (of 45 degrees, for example) from the first radius vector R2. The cam 14 has a second lobe 28 with an actuating surface at a radial distance R3 (of 1.25 inches, for example) from the pivot axis 18 which is substantially greater than the pivot distance d and greater than the radial distance R2 of the first lobe 26, the second lobe 28 being located on the third radius vector R3 from the pivot axis 18, the third radius vector R3 being angularly displaced by a lifting angle A (of 75 degrees, for example) from the first radius vector R2.

FIG. 2 shows a handle portion 20 mounted at 34 to the cam 14 perpendicular to the pivot axis 18 and at substantially a right angle to the first radius vector R2. The handle portion 20 clamps the ring 12 to the diving tank 2 by rotating the cam 14 to position the first lobe 26 into contact with the peripheral surface 15 of the tank 2 when the handle portion 20 is rotated into a storage position, as is shown in FIG. 5, adjacent to the peripheral surface 15 of the tank 2 and oriented substantially parallel with the cylindrical axis 4 of the tank 2. The handle portion 20 alternately frees the ring 12 for slidable engagement with the diving tank 2 by rotating the cam 14 to position the clearance surface 24 proximate to the peripheral surface 15 of the tank 2 when the handle portion 20 is rotated into a clearance position, as is shown in Figure,, which is displaced by the clearance angle of A=45 degrees from the storage position of FIG. 5. The handle portion 20 alternately clamps the ring 12 to the diving tank 2 by rotating the cam 14 to position the second lobe 28 into contact with the peripheral surface 15 of the tank 2 when the handle portion 20 is rotated into a lifting position as is shown in FIG. 3, which is displaced by the lifting angle (of A=75 degrees) from the storage position shown in FIG. 5.

In this manner, the diving tank handle 10 may be easily slipped onto the diving tank 2 with the handle portion 20 in the clearance position of FIG. 4, compactly stored while mounted on the diving tank 2 with the handle portion 20 folded down in the storage position as shown in FIG. 5, and the diving tank 2 carried with the handle portion 20 in the lifting position as is shown in FIG. 3.

The components of the diving tank handle invention can be made from a variety of materials, each suitable for a particular application's environment. Metals such as admiralty brass, a passive stainless steel such as 18-8 stainless type 304 or steel plated with a passive nickel or monel metal plating, will be suitably resistant to the galvanic corrosion frequently encountered in salt water environments. The metal components can be made by machining or casting, and in particular, significant savings can be made in manufacturing costs by casting the cam 14 and the handle portion 20 as an integral unit. Structural plastics can also be profitably used, such as polypropylene, polyurethane, and polycarbonate. The cam 14 and handle 20 can be integrally formed as a single piece by injection molding techniques using one of these plastics, resulting in a strong and corrosion-resistant unit. Polypropylene, in particular, has a resilient property which is useful in the cam 14. When the handle portion 20 is moved into the storage position of FIG. 5, the lobe 26 is brought into contact with the peripheral surface 15 of the tank 2 so as to lightly clamp the diving tank handle 10 into place on the tank 2 for compact and convenient storage. When the cam 14 is made of structural polypropylene, the lobe 26 will slightly compress in a resilient manner, thereby providing an effective clamping action without the possibility of abrading or denting the peripheral surface 15 of the tank 2. The clamping ring 12 can also be made from a structural plastic which can be molded around a reinforcing steel band or cable so as to resist the tensile force which is applied to the ring 12 when the handle portion 20 is raised into the lifting position of FIG. 3.

Although a specific embodiment of the invention has been disclosed, it will be understood by those having skill in the art that changes can be made to the relative sizes of the components and to their shapes and compositions without departing from the spirit and the scope of the invention.

What is claimed is:

1. A diving tank handle for selective attachment to a cylindrical diving tank, comprising:

a clamping ring having a substantially circular cross section with an inner diameter of slightly greater dimension than the outer diameter of of said diving tank, for slideably engaging the peripheral surface of said diving tank in an unclamped state and for frictionally engaging the peripheral surface of said diving tank in a clamped state, said clamping ring having an open side with a pair of opposed end surfaces;

a cam pivotally mounted to said clamping ring between said opposed end surfaces, on a pivot axis perpendicular to the cylindrical axis of said diving tank, said pivot axis being located at a pivot distance from said peripheral surface of said diving tank within said clamping ring, said cam having a first lobe with an actuating surface at a radial distance from said pivot axis which is slightly greater than said pivot distance, said first lobe being located on a first radius vector from said pivot axis, said cam having a clearance surface at a radial distance from said pivot axis which is slightly less than said pivot distance, said clearance surface being located on a second radius vector from said pivot axis, said second radius vector being angularly displaced by a clearance angle from said first radius vector, said cam having a second lobe with an actuating surface at a radial distance from said pivot axis which is substantially greater than said pivot distance and greater than said radial distance of said first lobe, said second lobe being located on a third radius vector from said pivot axis, said third radius vector being angularly displaced by a lifting angle from said first radius vector;

a handle portion mounted to said cam perpendicular to said pivot axis and at substantially a right angle to said first radius vector, for clamping said ring to said diving tank by rotating said cam to position said first lobe into contact with said peripheral surface of said tank when said handle portion is rotated into a storage position adjacent to said peripheral surface of said tank and oriented substantially parallel with said cylindrical axis of said tank, said handle portion alternately freeing said ring for slidable engagement with said diving tank by rotating said cam to position said clearance surface proximate to said peripheral surface of said tank when said handle portion is rotated into a clearance position which is displaced by said clearance angle from said storage position, said handle portion alternately clamping said ring to said diving tank by rotating said cam to position said second lobe into contact with said peripheral surface of said tank when said handle portion is rotated into a lifting position which is displaced by said lifting angle from said storage position;

whereby said diving tank handle may be easily slipped onto said diving tank with said handle portion in said clearance position, compactly stored while mounted on said diving tank with said handle portion in said storage position and said diving tank carried with said handle portion in said lifting position.

2. The apparatus of claim 1, wherein said clamping ring, said cam, and said handle portion are made of metal.

3. The apparatus of claim 2, wherein said metal is selected from the group consisting of admiralty brass, passive stainless steel, steel plated with passive nickel and steel plated with monel metal;

whereby said diving tank handle will be resistant to galvanic corrosion.

4. The apparatus of claim 2, wherein said cam and handle portion are formed by casting as a single unit.

5. The apparatus of claim 1, wherein said cam and handle portion are made from a structural plastic.

6. The apparatus of claim 5, wherein said structural plastic is selected from the group consisting of polypropylene, polyurethane, and polycarbonate.

7. The apparatus of clain 6, wherein said cam and handle portion are integrally formed as single piece by injection molding.

8. The apparatus of claim 1, wherein said cam is made of structural polypropylene to impart a compressive resiliency to said first lobe;

whereby said first lobe will provide an effective clamping action when said handle portion is in said storage position, without the possibility of abrading or denting said peripheral surface of said diving tank.

9. The apparatus of claim 1, wherein said clamping ring is made from a structural plastic molded around a steel band;

whereby said clamping ring is resistant to corrosion and has a high tensile strength to withstand the tensile force applied to said ring when said handle portion is raised into said lifting position.

10. The apparatus of claim 1, wherein said cam is made of structural polypropylene to impart a compressive resiliency to said first lobe to provide an effective clamping action when said handle portion is in said storage position, without the possibility of abrading or denting said peripheral surface of said diving tank;

said clamping ring being made from a structural plastic molded around a steel band making said clamping ring resistant to corrosion and giving it a high tensile strength to withstand the tensile force applied to said ring when said handle portion is raised into said lifting position.

* * * * *